US006597638B2

(12) United States Patent
Droux

(10) Patent No.: US 6,597,638 B2
(45) Date of Patent: Jul. 22, 2003

(54) APPARATUS AND METHODS FOR ATTACHMENT AND DETACHMENT OF WATCH STRAPS

(75) Inventor: Rene Droux, Bienne (CH)

(73) Assignee: Movado Group, Inc., Woodcliff Lake, NJ (US)

( * ) Notice: Subject to any disclaimer, the term of this patent is extended or adjusted under 35 U.S.C. 154(b) by 0 days.

(21) Appl. No.: 09/865,745

(22) Filed: May 25, 2001

(65) Prior Publication Data

US 2002/0176325 A1 Nov. 28, 2002

(51) Int. Cl.[7] ..... G04C 37/00; G04D 3/00

(52) U.S. Cl. ..... 368/327; 368/316; 81/6; 7/101

(58) Field of Search ..... 368/309, 327, 368/311, 313, 316–317; 224/167–168; 269/287; 81/6; 968/665, 684, 673, 676–677; 7/101

(56) References Cited

U.S. PATENT DOCUMENTS

| | | | | |
|---|---|---|---|---|
| 251,183 A | * | 12/1881 | Bullock | 81/6 |
| 2,774,266 A | * | 12/1956 | Sheffield | 81/6 |
| 3,689,056 A | * | 9/1972 | Wiltgen | 269/10 |
| 5,208,929 A | | 5/1993 | Chou | 7/101 |
| 5,388,082 A | * | 2/1995 | Chou | 368/327 |

FOREIGN PATENT DOCUMENTS

| | | | |
|---|---|---|---|
| CH | 9111/67 | 4/1969 | G04D/3/04 |
| CH | 4904/69 | 9/1970 | G04D/1/02 |
| EP | 0 494 584 | 7/1992 | A44C/5/14 |
| EP | 0 871 094 | 10/1998 | G04D/1/00 |

OTHER PUBLICATIONS

Lecureux SA, *Posage pour le montage de bracelet*, date unknown.

* cited by examiner

*Primary Examiner*—David Martin
*Assistant Examiner*—Michael L. Lindinger
(74) *Attorney, Agent, or Firm*—Fish & Neave; Edward M. Arons; Laura A. Sheridan

(57) ABSTRACT

Apparatus and methods for attachment and detachment of watch straps are provided. The apparatus and methods of the present invention may be used to attach a strap to and detach a strap from a watch having a strap attached by a compressible spring bar. In some embodiments, the invention may include a tool for attaching and detaching the strap that has a base and a blade. The base may support the watch and the blade may protrude from the base to compress the spring bar and release it from the body of the watch. The blade may have a notch for engaging the spring bar.

18 Claims, 8 Drawing Sheets

APPARATUS AND METHODS FOR ATTACHMENT AND DETACHMENT OF WATCH STRAPS

BACKGROUND OF THE INVENTION

This invention relates to apparatus and methods for attachment and detachment of watch straps. In particular, it relates to attaching and detaching watch straps secured to watch cases by spring bars.

Watch straps are commonly affixed to watch cases by compressible spring bars that pass through sleeves at strap ends. Spring-loaded ends of the spring bars are inserted into holes in the watch cases and are held in place by spring-generated compressive forces. The affixed spring bar and the body of the watch form a closed loop that retains the watch strap sleeve.

A strap is often detached by using a sharp handheld tool or blade (e.g., a knife blade). A different strap can be attached by using the same tool. The tool is used to compress the spring bar and thereby allow the straps to be attached and detached. In industrial settings, such as watch assembly facilities, a user can use the tool to assemble new watches (for example, for consumers). The tool may be used repetitively to assemble a large number of watches.

A disadvantage of available tools is that there is a risk of scratching portions of a watch, such as the crystal or the case. This is at least in part because the tools lack a means for supporting and stabilizing the watch during strap detachment and attachment.

Another disadvantage of available tools is that they are too difficult for most watch owners and consumers to use for detaching and attaching their own watch straps.

A further disadvantage of available tools is that under industrial conditions, wear and tear can degrade tool sharpness.

Therefore, it would be desirable to provide apparatus and methods for attaching and detaching a watch strap while supporting the watch and reducing the risk of damaging the watch.

It would also be desirable to provide apparatus and methods for attaching and detaching a watch strap that are easier to use than available tools and methods.

It would further be desirable to provide apparatus and methods for attaching and detaching a watch strap that provides for blade replacement and interchangeability.

SUMMARY OF THE INVENTION

Embodiments of the present invention may provide apparatus and methods for attaching and detaching a watch strap from a watch while supporting the watch and reducing the risk of damaging the watch.

Some of these embodiments may provide apparatus and methods for attaching and detaching a watch strap using a tool that has a replaceable, interchangeable, or adjustable blade.

In some embodiments, the invention may include a tool for attaching a strap to a watch or detaching a strap from a watch. The tool may include a base for supporting the watch and a blade for compressing the spring bar that protrudes from the base.

BRIEF DESCRIPTION OF THE DRAWINGS

The above and other objects and advantages of the present invention will be apparent upon consideration of the following detailed description, taken in conjunction with the accompanying drawings, in which like reference characters refer to like parts throughout, and in which.

DETAILED DESCRIPTION OF THE INVENTION

Figure 1:
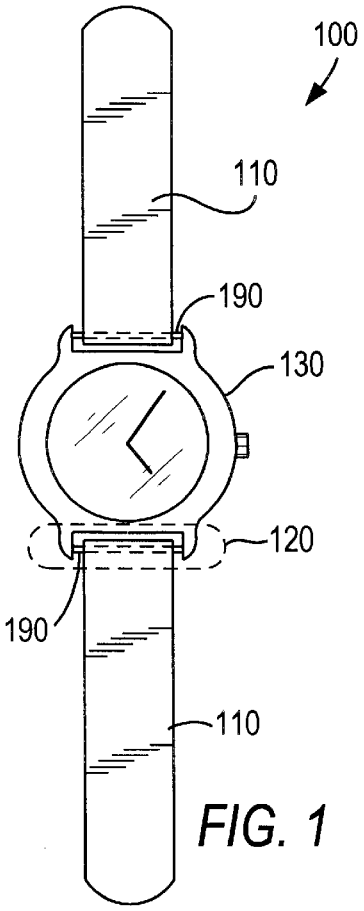
FIG. 1 is a top view of an example of a watch suitable for use with some embodiments of the present invention.

Some embodiments of the present invention may provide apparatus and methods for attachment and detachment of watch straps. The apparatus and methods may be used with a watch having a strap attached by a compressible spring bar. In some of these embodiments, the invention may include a tool for attaching a strap to a watch or detaching a strap from a watch. The tool may include a base for supporting the watch and a blade for compressing the spring bar that protrudes from the base. The blade may be used to compress and decompress the spring bar when compression and decompression of the spring bar are required to either disengage the spring bar from the watch case or to secure the spring bar in holes in the watch case. When used to attach a strap to a watch, the blade may be used to compress the spring bar, align a loose spring bar end with a hole in the watch case, and secure the spring bar by releasing the end into the hole. When used to detach a strap from a watch, the blade may be used to compress the spring bar, retract the end of the spring bar from the hole, and disengage the spring bar from the watch.

The base may be constructed from any suitable material. In some embodiments, the blade may be constructed from low friction or self-lubricating material. For example, the blade may be constructed from or coated with a layer of fluoropolymer (such as that sold under the trademark TEFLON®, by E. I. du Pont de Nemours & Company), polyethylene, other polymers or copolymers, or a composite. This feature may reduce the risk of scratching a watch crystal.

In some embodiments, the blade may have one portion that is attached to the base and another portion that may include a notch suitable for holding, gripping, pinching, or otherwise engaging a spring bar.

In some embodiments, the base may include a slot. The attached portion of the blade may be attached in the slot. The blade may be removably attached in the slot, rotatably attached in the slot, or attached in the slot in any other suitable manner. In other embodiments, the blade may be attached to a side of the base. In some of these embodiments, the blade may be removably attached, rotatably attached, or attached in any other suitable manner. In some embodiments, the blade may be hinged to the base.

Blades that are suitable for different spring bar styles, configurations, or properties may be provided. Blades may include notches that may have wide or narrow openings for accommodating spring bars of different diameters. Notches may have shapes that match different spring bar cross sectional shapes. Notches may be deep or shallow to provide a desired amount of clearance between the spring bar and the watch case. Notches may have sharp edges (e.g., for gripping spring bars constructed from hard material), blunt or rounded edges (e.g., for engaging spring bars constructed from soft or easily scratched material), roughened edges, toothed edges, beveled edges, or any other suitable edge design. Blades may include resistant material such as carbide or stainless steel (e.g., to reduce wear). In some embodiments, alternative, additional, or replacement blades may be provided.

The ends of some spring bars may have raised annular shoulders to facilitate proper insertion or protect against over-relaxation of the spring bar spring. Blades of different widths may be provided to fit between shoulders of different configurations or arrangements. The blade width may also be selected to enable the blade to fit between a shoulder and the watch. Blade edges may be tapered or beveled to facilitate engagement of spring bars having shoulders. Blades of different configurations may be provided to engage spring bars of different heights. (As used herein, "height" refers to the shortest distance between the spring bar and a plane coinciding with the back surface of the watch.)

In some embodiments, the blade may be repositioned to different angles with respect to the base. Positioning the blade to different angles may permit the tool to accommodate watches having spring bars of different heights. For example, a watch with a spring bar having a height of about 2 mm and a watch with a spring bar having a height of about 3 mm may be accommodated by repositioning the blade to different angles. Blades may be slidably, rotatably, or concurrently slidably and rotatably attached to provide translational and rotational control of the blade, blade tip, or notch.

In some embodiments in which the tool is used to detach a strap from a watch, a blade may automatically align itself so that the portion of the blade that engages spring bars is positioned correctly for engaging the spring bar. For example, the tool may be used initially to detach a strap from a watch having a spring bar height of 2 mm. The tool may then be used to detach a strap from a watch having a spring bar height of 3 mm without the need for adjusting the blade position in a separate step because the blade self-aligns to the higher spring bar in response to mechanical resistance from the spring bar. Similarly, the blade may automatically adjust from a higher position to a lower position.

In some embodiments, the present invention may include a tool for attaching a strap to a watch or detaching a strap from a watch. The tool may include a base for supporting the watch and a blade for compressing a spring bar that protrudes from the base. The blade may be repositioned to different angles with respect to the base by rotating the blade. The base limits the rotation of the blade to less than 360°.

Some embodiments of the invention may include methods for detaching a watch strap from a watch case. To detach a strap from a case, the case may be placed on a surface of a base. A spring bar that holds the strap to the case may be separated from the case using a blade protruding from the base to compress the spring bar against a portion of the watch case (for example, against a boss, lug, or other supporting member on the case). The tip of the spring bar may then be retracted from a spring bar hole in the watch case. The spring bar may be disengaged from the watch by rotating the watch so that the spring bar is out of alignment with the spring bar hole. The strap may then be removed by sliding it off the spring bar or by removing the spring bar entirely from the watch case.

Some embodiments of the invention may include methods for attaching a watch strap to a watch case. To attach a strap, a watch may be placed on a surface of a base. A spring bar engaged with a watch strap may be joined to the case by compressing the spring bar between a blade protruding from the base and a portion of the case supporting the end of the spring bar opposite the blade. In some embodiments, the spring bar may be joined to the case by rotating the case so that the spring bar is in alignment with a spring bar hole.

The apparatus and methods of the present invention may be used to attach a strap to, and detach a strap from, watches having straps attached by a compressible spring bar. A brief description of a generic watch for use with the present invention is provided to illustrate some of the features of embodiments of the present invention.

Figure 2:
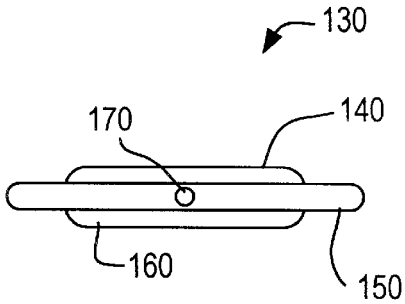
FIG. 2 is a side view of the watch case shown in FIG. 1.
Figure 3:
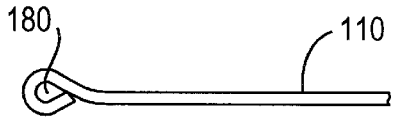
FIG. 3 is a side view of the watch strap shown in FIG. 1.

FIGS. 1–5 are various views of an example of a watch that may be used with the present invention. FIG. 1 shows watch 100 having strap 110 and case 130. Strap 110 is attached to case 130 with compressible spring bar 190. FIG. 2 shows a side view of case 130. As shown, case 130 may include crystal 140, middle case 150 with crown 170, and back case 160. FIG. 3 shows a portion of strap 110. The portion shown includes wrapped hole 180. Wrapped hole 180 may house spring bar 190 (as shown in FIG. 1). In this example, wrapped hole 180 may be formed by wrapping the end of strap 110 into a loop, but various structures (e.g, fabric or metal rings, sleeves, or crimped structures) may be used to house spring bar 190. Spring bar 190 may be attached to strap 110 by any other other suitable method.

Figure 4:
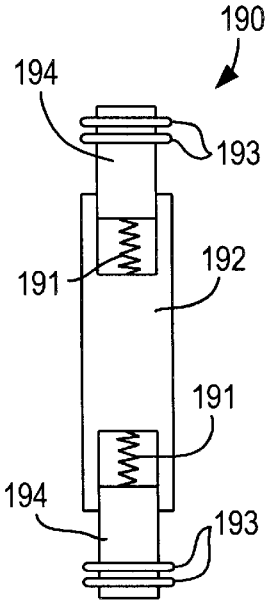
FIG. 4 is an exploded sectional view of the spring bar shown in FIG. 1.

FIG. 4 shows an exploded top view of spring bar 190. Spring bar 190 includes spring bar body 192, which houses springs 191 and spring bar tips 194. Spring bar tips 194 may be rigidly attached to springs 191 by soldering, crimping, or any other suitable means for attachment. Each spring bar tip 194 may have one or more shoulders 193. However, various embodiments of the invention may be practiced on spring bar tips without shoulders 193.

Figure 5:
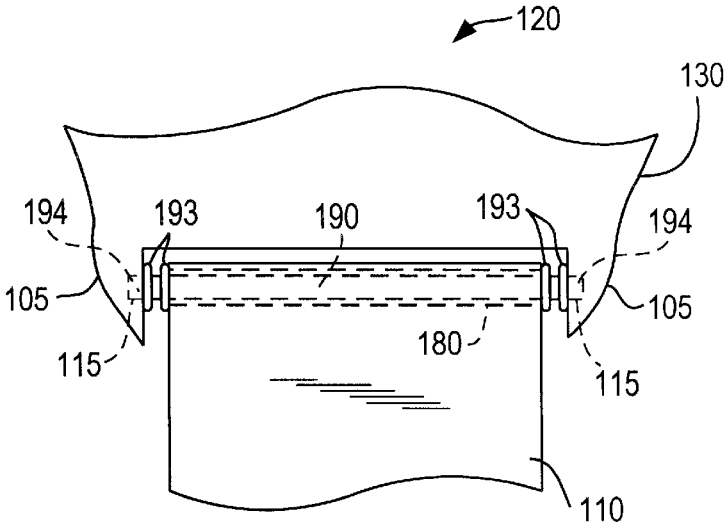
FIG. 5 is an exploded top view of a region of the watch shown in FIG. 1.

FIG. 5 shows region 120 of watch 100 (shown in FIG. 1 by the region enclosed by the dotted line). Region 120 shows in detail some of the interrelationships among spring bar 190, case 130, and strap 110 when strap 110 is attached to case 130. As shown, case 130 may include two spring bar holes 115. Spring bar holes 115 may be formed in lugs 105 of case 130. Spring bar 190 may be housed within wrapped hole 180 of strap 110, with its two spring bar tips 194 within spring bar holes 115. Shoulders 193 on each spring bar tip 194 may be located between a spring bar hole 115 and strap 110. Spring bar 190, however, does not necessarily include shoulders 193. Although region 120 is shown for one portion of strap 110, the interrelationships among spring bar 190, strap 110, and case 130 may be identical for the other portion of strap 110.

FIGS. 6–20 show various embodiments of a watch strap tool in accordance with the present invention.

Figure 6:
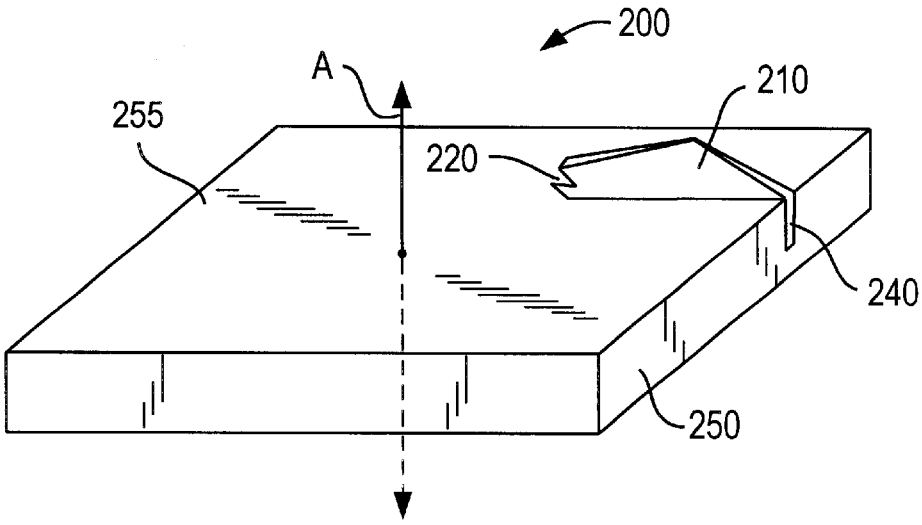
FIG. 6 is a perspective view of an illustrative example of a watch strap tool in accordance with some embodiments of the present invention.

FIG. 6 shows an illustrative example of tool 200 for detaching a strap from, and attaching a strap to, a watch (e.g., strap 110 of watch 100 as shown in FIGS. 1–5). Tool 200 may include base 250 and blade 210. Base 250 may support the watch on surface 255. For example, base 250 may support case 130 of watch 100 (as shown in FIG. 1). The bottom of base 250 may include pads (made, e.g., of rubber or synthetic material) to reduce slippage (not shown).

Blade 210 protrudes from base 250 and is capable of compressing a spring bar (such as spring bar 190 shown in FIG. 4) when one end of the spring bar is urged toward the blade. Blade 210 may have notch 220 for engaging the spring bar. If the spring bar has shoulders, such as shoulders 193 of spring bar 190 (as shown in FIG. 4), notch 220 may engage the spring bar adjacent or between the shoulders. If the spring bar has no shoulders, notch 220 may engage the spring bar at a portion of the spring bar between strap 110 and a lug (such as lug 105 shown in FIG. 5).

Base 250 may include slot 240. Slot 240 may be used to house at least a portion of blade 210. Blade 210 may be attached in slot 240. In some embodiments, blade 210 may be removably attached in slot 240. For example, blade 210 may be removable from tool 200 so that a different blade may be attached to base 250. In some embodiments, blade 210 may be rotatably attached in slot 240.

Figure 7:
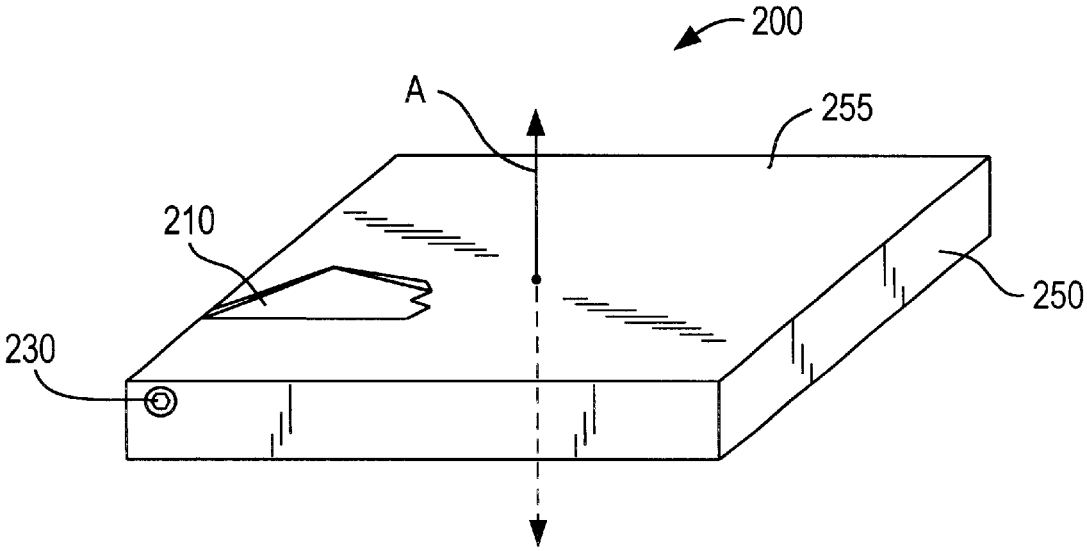
FIG. 7 is another perspective view of the watch strap tool shown in FIG. 6.

FIG. 7 shows tool 200 as rotated 180 degrees about axis A from the view of FIG. 6. FIG. 7 shows nut 230, which may be attached to a pin, bolt, threaded rod, or other suitable elongated member (not shown) within base 250 around which blade 210 may rotate. This rotation may adjust the angle of blade 210 with respect to surface 255 of base 250.

Figure 8:
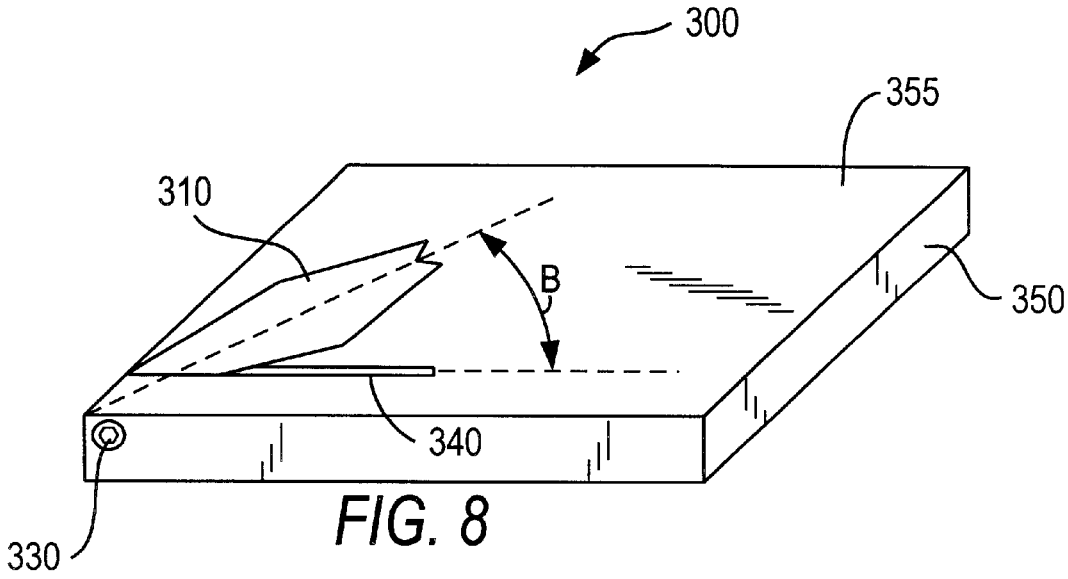
FIG. 8 is a perspective view of another illustrative example of a watch strap tool in accordance with some embodiments of the present invention.

FIG. 8 illustrates a blade rotation feature of some embodiments of the invention. Tool 300 may include blade 310 that is repositionable to different angles by rotating blade 310 about an elongated member (internal to base 350; not shown) that may be secured by nut 330. For example, blade 310 may be positioned at angle B with respect to surface 355 of base 350. Angle B may be increased or decreased to reposition blade 310 for operation on a watch having a first spring bar height (relative to surface 355). Blade 310 may then be repositioned to accommodate a watch having a second spring bar height differing from the first spring bar height. FIG. 8 also shows slot 340. At least a portion of blade 310 may be housed below surface 355 of base 350 within slot 340. Slot 340 may be large enough to accommodate all of blade 310.

Figure 9:
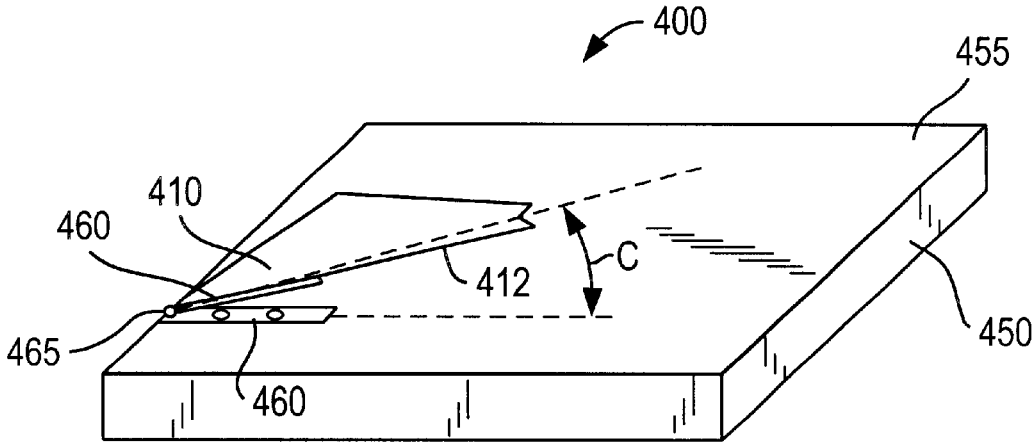
FIGS. 9–10 are perspective views of yet another illustrative example of a watch strap tool in accordance with some embodiments of the present invention.
Figure 10:
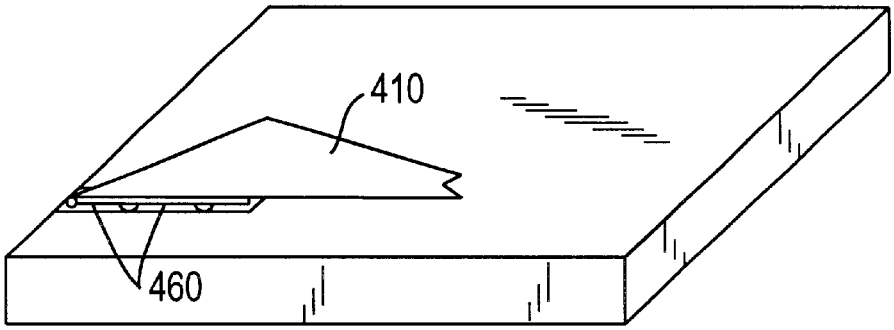

FIGS. 9–10 show another illustrative example of a tool for detaching a strap from, and attaching a strap to, a watch (e.g., strap 110 of watch 100 as shown in FIGS. 1–5). FIG. 9 shows tool 400 which may include blade 410 that is hinged to base 450. Hinge 460 may join blade 410 and surface 455 so that angle C of the blade with respect to the surface may be adjusted. After positioning blade 410 to a desired angle C, the blade may remain at the desired angle due to a friction fit between hinge 460 and bolt 465 that holds the two portions of the hinge together. FIG. 10 shows hinge 460 in a closed position. In the embodiment shown in FIGS. 9–10, base 450 does not have a slot. However, base 450 may have a slot similar to those shown in FIGS. 6–8 (e.g., slots 240 and 340). In some embodiments, blade 410 may be fixed to base 450 by a hinge parallel to edge 412. In these embodiments, blade 410 may be "folded" down to a position parallel to surface 455 (e.g., for storage or shipping).

Figure 11:
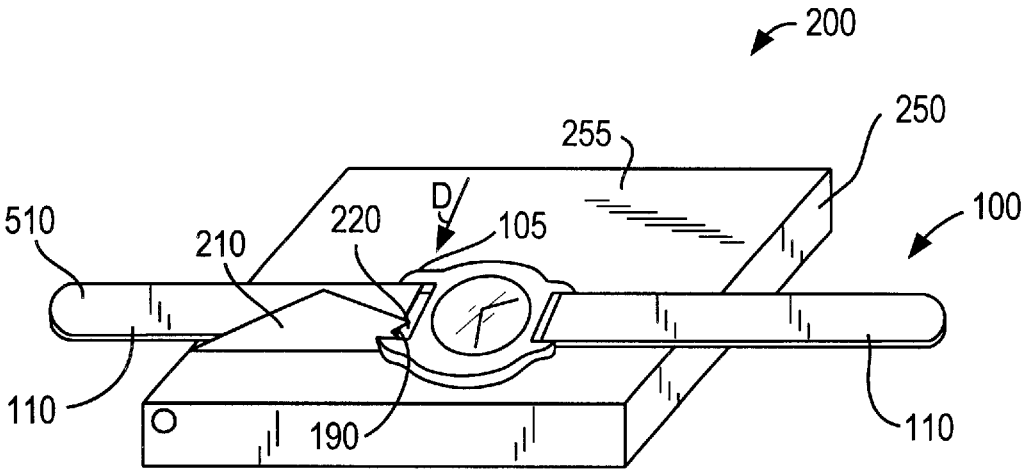
FIGS. 11–13 are perspective views demonstrating illustrative examples of methods for detaching a strap from a watch using the apparatus of FIGS. 6–7 in accordance with some embodiments of the present invention.
Figure 12:
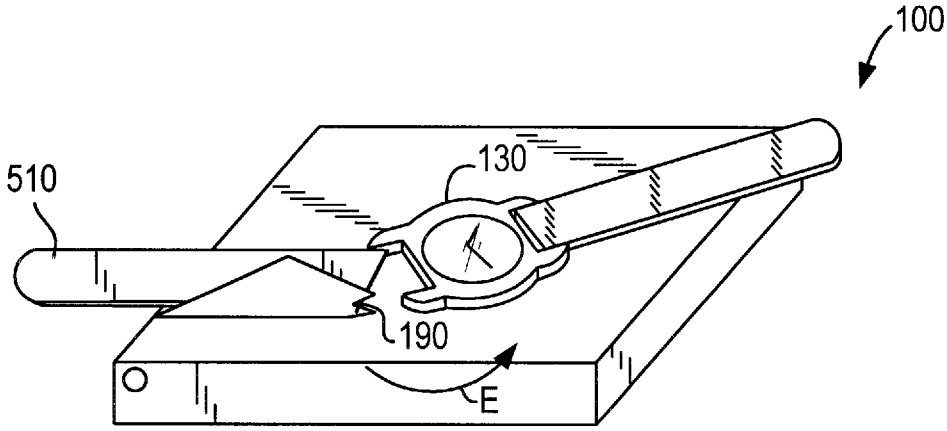
Figure 13:
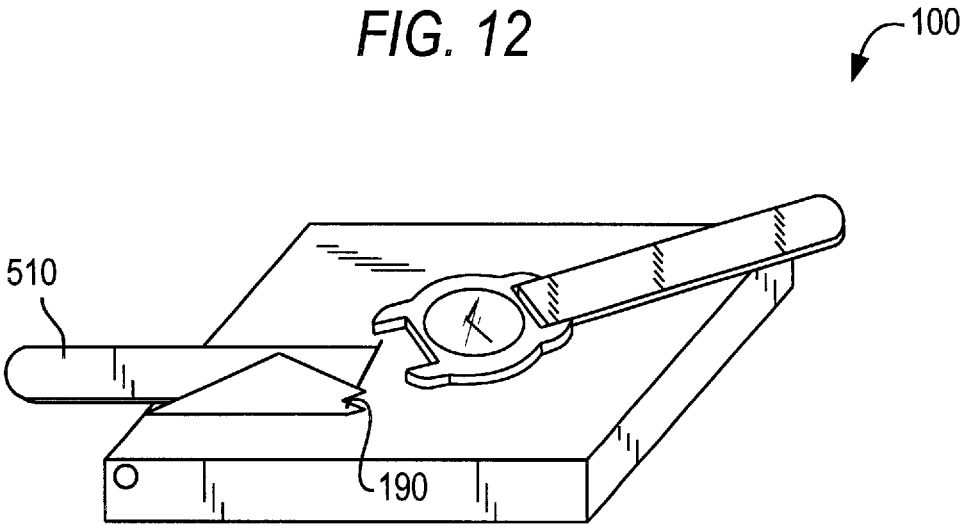

FIGS. 11–13 show illustrative examples of methods for detaching a portion of a watch strap from a watch in accordance with the invention using, for example, a tool such as that shown in FIGS. 6–7. As shown in FIG. 11, a watch such as watch 100 (as shown in FIGS. 1–5), including strap portion 510 of strap 110 (which is to be detached), is placed on surface 255 of base 250. Watch 100 is moved relative to base 250 so that blade 210 engages spring bar 190. In some embodiments, notch 220 may engage spring bar 190. If spring bar 190 has shoulders 193 (as shown in FIG. 4), some of these embodiments may engage the shoulders to facilitate compression of the spring bar. With spring bar 190 engaged by blade 210 or gripped by notch 220, watch 100 may be pushed in the direction of arrow D to compress spring bar 190 between blade 210 and lug 105.

The compression of spring bar 190 may retract a spring bar tip (e.g., spring bar tip 194 of FIG. 4) from a spring bar hole (e.g., spring bar hole 115 of FIG. 5), thus enabling case 130 to be rotated in the direction of arrow E, as shown in FIG. 12, while portion 510 remains in place. The rotation of case 130 may cause spring bar 190 to come out of alignment with the spring bar hole. FIG. 13 shows that strap portion 510 may then be detached from the watch.

Figure 14:
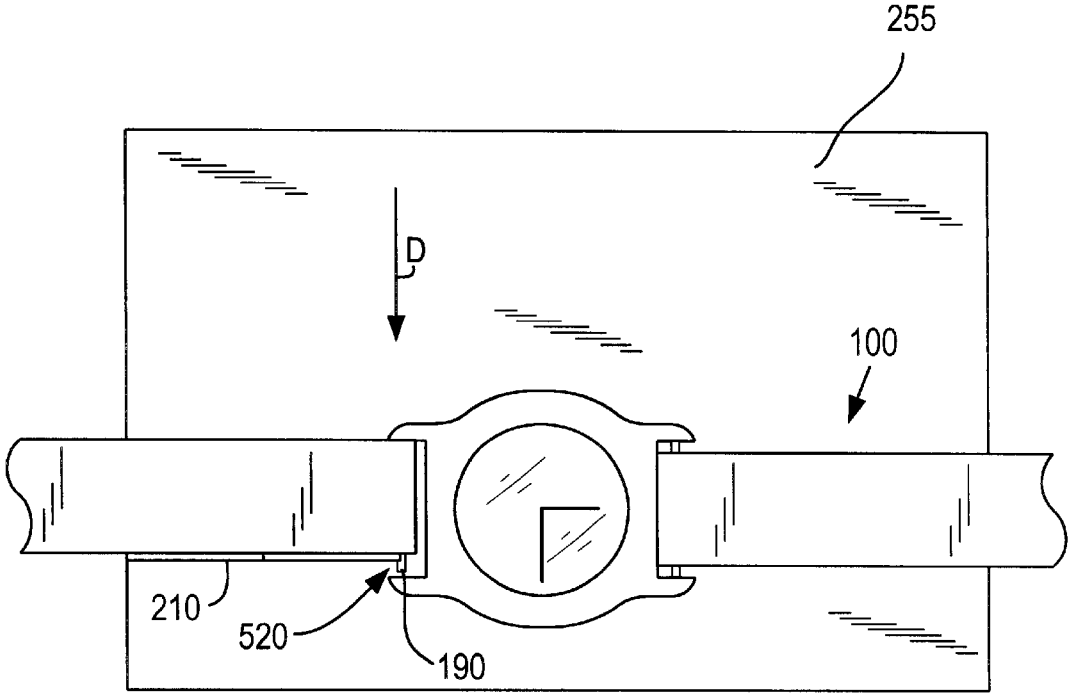
FIG. 14 is a top view of the illustrative example shown in FIG. 11 in accordance with some embodiments of the present invention.

FIG. 14 shows a top view of the example shown in FIG. 11. Spring bar 190 may be engaged by blade 210. In some embodiments, spring bar 190 may be gripped by notch 220 (not shown). Watch 100 may be pushed in the direction of arrow D to compress spring bar 190. The compression of spring bar 190 may retract a spring bar tip (e.g., spring bar tip 194 of FIG. 4) from a spring bar hole (e.g., spring bar hole 115 of FIG. 5), yielding clearance 520 between the spring bar and the spring bar hole.

Figure 15:
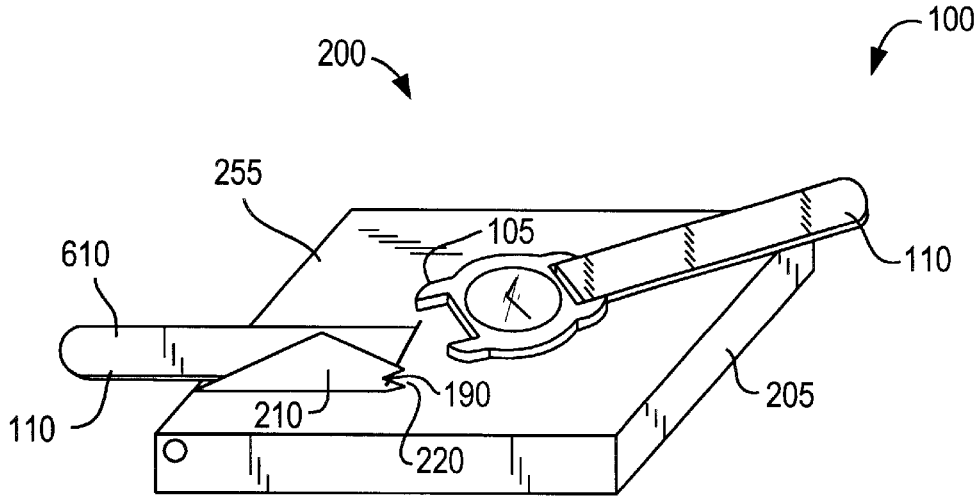
FIGS. 15–17 are perspective views demonstrating illustrative examples of methods for attaching a strap to a watch using the apparatus of FIGS. 6–7 in accordance with some embodiments of the present invention.
Figure 16:
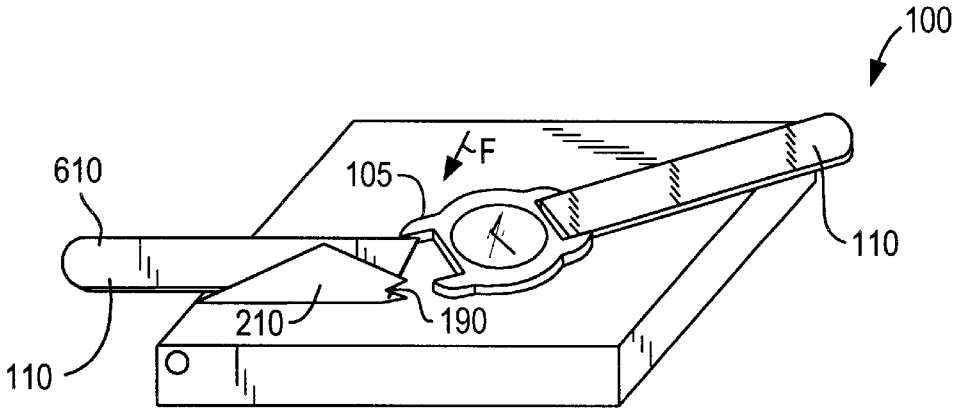
Figure 17:
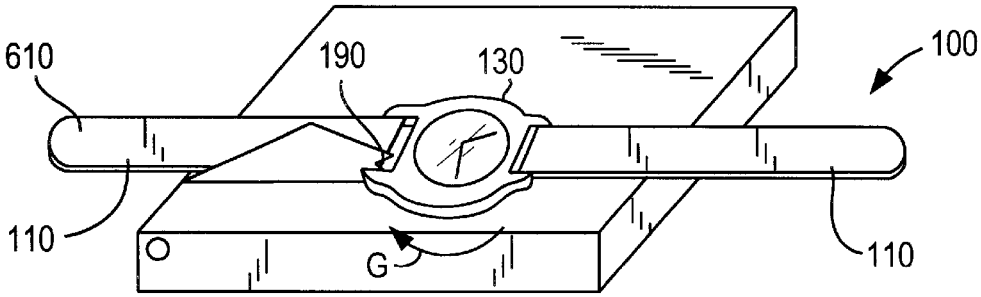

FIGS. 15–17 show illustrative examples of methods for attaching a portion of a watch strap to a watch using, for example, a tool such as that shown in FIGS. 6–7. As shown in FIG. 15, a watch such as watch 100 (shown in FIGS. 1–5), including strap portion 610 of strap 110 (which is to be attached), is placed on surface 255 of base 250. Strap portion 610 is moved relative to base 250 so that blade 210 engages spring bar 190. (Spring bar 190 has already been threaded through wrapped hole 180, as shown in FIG. 3.) In some embodiments, notch 220 may engage spring bar 190. If spring bar 190 has shoulders 193 (as shown in FIG. 4), some of these embodiments may engage the shoulders to facilitate compression of the spring bar.

FIG. 16 shows that lug 105 may be used to support one end of spring bar 190. For example, a spring bar tip may be inserted in a spring bar hole in lug 105. Watch 100 may be pushed in the direction of arrow F so that spring bar 190 is compressed between lug 105 and blade 210 (for example, at notch 220).

FIG. 17 shows that case 130 may be rotated in the direction of arrow G. The rotation of case 130 may cause the portion of spring bar 190 engaged by blade 210 to come into alignment with a spring bar hole in a lug opposite the lug that was used to support one end of the spring bar. Strap portion 610 is thus joined to case 130.

Figure 18:
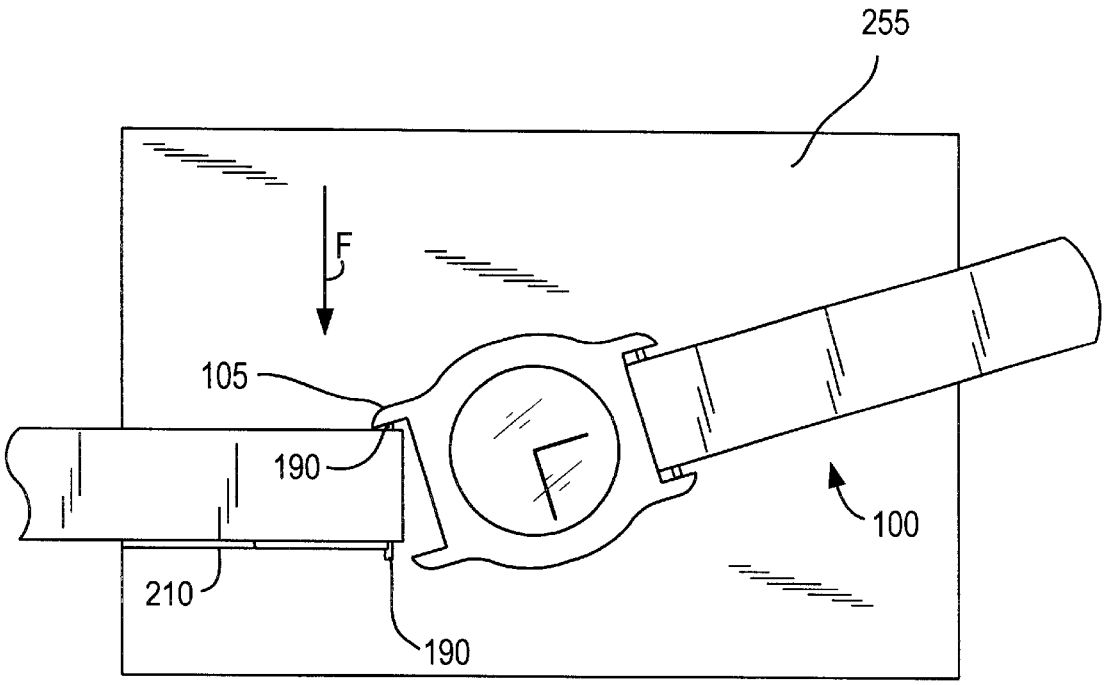
FIG. 18 is a top view of the illustrative example shown in FIG. 16 in accordance with some embodiments of the present invention.

FIG. 18 shows a top view of the example shown in FIG. 16. Lug 105 may support one end of spring bar 190. For example, a spring bar tip may be inserted in a spring bar hole in lug 105. Watch 100 may be pushed in the direction of arrow F so that spring bar 190 is compressed between lug 105 and blade 210.

Figure 19:
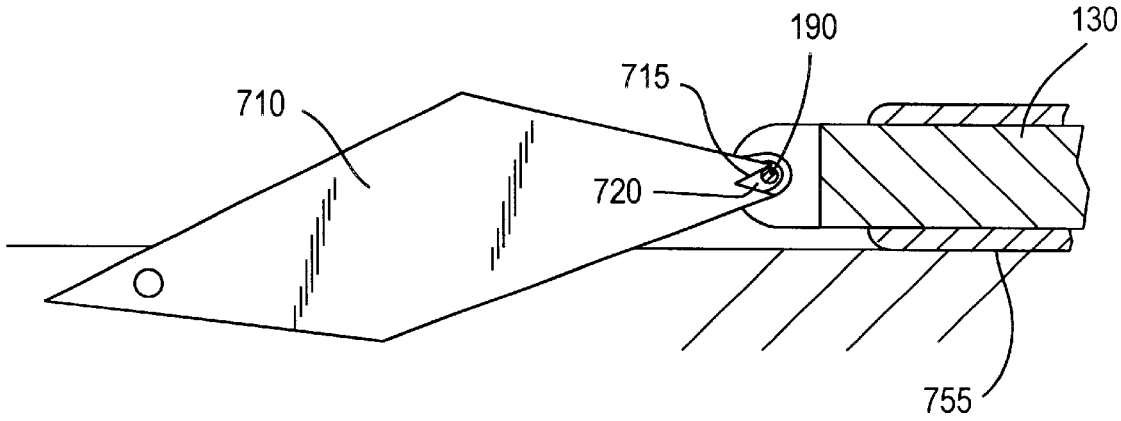
FIGS. 19–20 are side sectional views demonstrating an illustrative example of a self-aligning feature of the apparatus of FIGS. 6–7 in accordance with some embodiments of the present invention.
Figure 20:
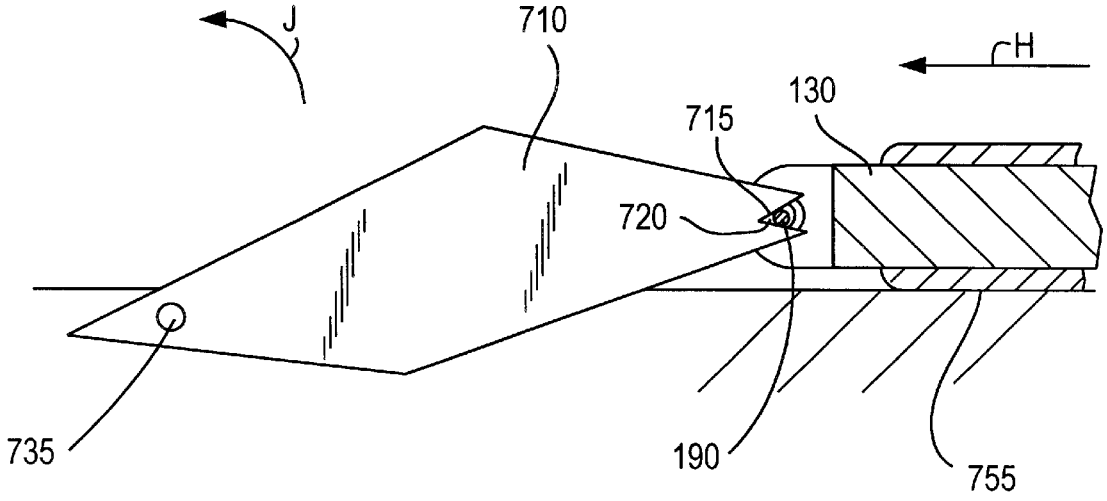

FIGS. 19–20 show an illustrative example of a self-alignment feature of the present invention. FIG. 19 shows spring bar 190 in contact with edge 715 of notch 720. The position of blade 710 is not well-matched to the height of spring bar 190.

FIG. 20 shows that by moving case 130 in the direction of arrow H along surface 755, spring bar 190 may push blade 710 at edge 715 and rotate blade 710 about pin 735 in the direction of arrow J so that notch 720 properly engages spring bar 190. In some embodiments, pin 735 may be attached to a nut (e.g., nut 230 of FIG. 7). The nut may be tightened so that blade 710 is provided with mechanical resistance that is large enough to maintain the alignment of the blade while allowing it to rotate about pin 735. Tn some embodiments, a slot (e.g., slot 240 of FIG. 6) may provide blade 710 with mechanical resistance. However, any other suitable means for providing mechanical resistance may be used to maintain the alignment of blade 710 while allowing it to rotate.

It will be understood that the foregoing is only illustrative of the principles of the invention, and that various modifications can be made by those skilled in the art without departing from the scope and spirit of the invention.

What is claimed is:

1. A tool for attaching and detaching a strap from a watch, the strap being attached to the watch by a spring bar, the tool comprising:

a base for supporting the watch; and a blade for compressing the spring bar, wherein the blade protrudes from the base and can be repositioned to different angles with respect to the base by rotating the blade, and wherein the base limits the rotation of the blade to less than 360°.

2. The tool of claim 1 wherein the blade has a first portion and a second portion, the first portion attached to the base, the second portion comprising a notch for engaging the spring bar.

3. The tool of claim 2 wherein the base has a slot, the first portion being attached in the slot.

4. The tool of claim 2 wherein the base has a slot, the first portion being removably attached in the slot.

5. The tool of claim 2 wherein the base has a slot, the first portion being rotatably attached in the slot.

6. The tool of claim 2 wherein the first portion is hinged to the base.

7. The tool of claim 1 wherein the blade is self-aligning.

8. The tool of claim 1 wherein the blade is self-lubricating.

9. A method for detaching a strap from a watch, the strap being attached to the watch by a spring bar, the method comprising:

placing the watch on a surface of a base, wherein a first blade protrudes from the base and is positioned at an angle with respect to the base;

adjusting the angle; and separating the spring bar from the watch using the first blade.

10. The method of claim 9 wherein the separating comprises retracting a tip of the spring bar from a spring bar hole.

11. The method of claim 10 wherein the retracting comprises compressing the spring bar with the first blade.

12. The method of claim 9 wherein the separating comprises rotating the watch so that the spring bar is out of alignment with a spring bar hole.

13. The method of claim 9 further comprising replacing the first blade with a second blade.

14. The method of claim 9 wherein the separating comprises contacting the spring bar with the first blade so that the first blade automatically rotates to engage the spring bar.

15. A method for attaching a strap to a watch using a spring bar, the method comprising:

placing the watch on a surface of a base, wherein a first blade protrudes from the base and is positioned at an angle with respect to the base;

adjusting the angle; and joining the spring bar to the watch using the first blade.

16. The method of claim 15 wherein the joining comprises compressing the spring bar with the blade.

17. The method of claim 15 wherein the joining comprises rotating the watch so that the spring bar is in alignment with a spring bar hole.

18. The method of claim 15 further comprising replacing the first blade with a second blade.

* * * * *